United States Patent [19]

Connors

[11] 3,949,500

[45] Apr. 13, 1976

[54] ADJUSTABLE NEEDLEPOINT HOLDING FRAME

[76] Inventor: Dorothy Connors, 3900 Silverleaf Ave., Orange, Calif. 92669

[22] Filed: Aug. 27, 1975

[21] Appl. No.: 608,050

[52] U.S. Cl. ..... 38/102.5; 160/372; 160/395

[51] Int. Cl.[2] ..... D06C 3/08

[58] Field of Search ..... 38/102–102.91; 101/127.1, 128; 160/371, 372, 374, 377, 378, 381, 382, 395, 391

[56] References Cited

UNITED STATES PATENTS

| | | | |
|---|---|---|---|
| 3,837,099 | 9/1974 | Dalton et al. | 38/102.5 |
| 3,896,573 | 7/1975 | Gibby | 38/102.5 |

*Primary Examiner*—G. V. Larkin

[57] ABSTRACT

A manually adjustable, open, four-sided frame that may be dimensionally expanded or contracted to support a sheet of fabric on which needlepoint work is being performed in a taut condition.

4 Claims, 5 Drawing Figures

FIG. 1
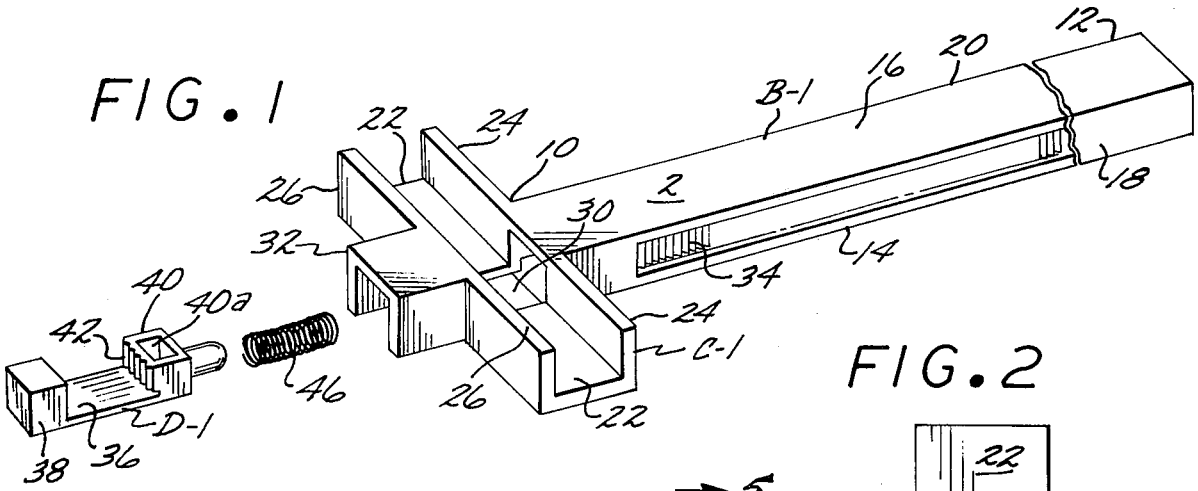
FIG. 2
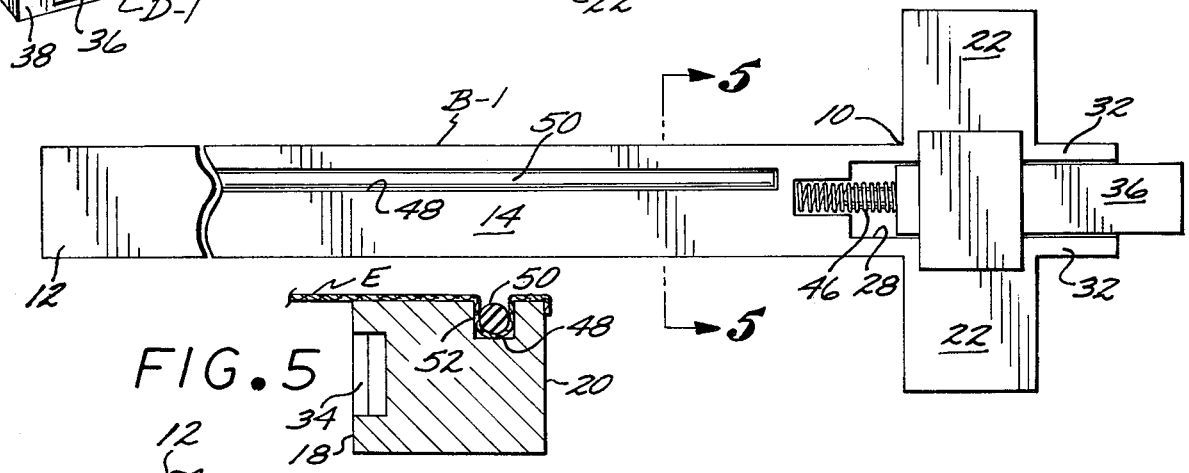
FIG. 5
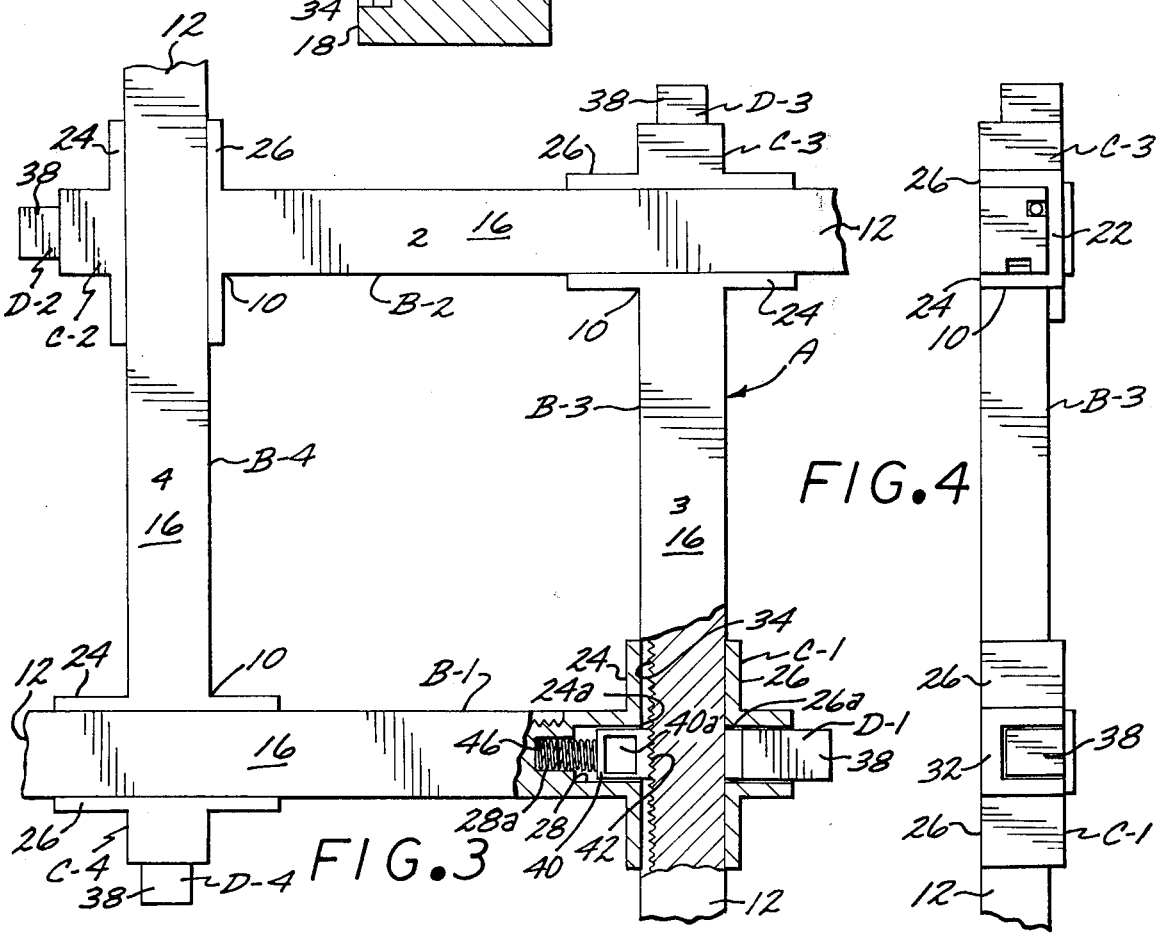
FIG. 3
FIG. 4

ADJUSTABLE NEEDLEPOINT HOLDING FRAME

BACKGROUND OF THE INVENTION

1. Field of the Invention

Adjustable needlepoint holding frame.

2. Description of the Prior Art

Needlepoint is performed on fabric work pieces of various length and width. The work piece, in the form of a sheet of fabric, is preferably held in a taut condition within the confines of the frame during the time needlepoint work is performed thereon. Prior to the present invention, a light weight, rectangular frame that was dimensionally adjustable to the particular size of a needlepoint sheet, was not available. More particularly a frame that, when not in use, could be taken apart and the frame element stored side-by-side to occupy a minimum of space.

The primary object in devising the present invention is to supply a dimensionally adjustable frame to removably support needlepoint work, as well as a frame that is light in weight and portable, can be fabricated from molded, plastic elements, and when not in use may be easily taken apart for the elements comprising the same to be stored side-by-side in parallel relationship in a space of minimum size.

SUMMARY OF THE INVENTION

A needlepoint supporting frame that is dimensionally adjustable to the size of a particular needlepoint work piece, which work piece may be removably secured to the frame after the latter is adjusted to a desired size. The needlepoint supporting frame is defined by an assembly of four elements, with each element including a light weight, elongate member having first and second ends. Each first end of an elongate member supports a head on which a spring loaded locking member is mounted.

The elements, when arranged in first and second normally disposed pairs, have the heads thereof adjustably held in interlocking relationship with the elongate member most adjacently disposed thereto, and the first and second pairs of elements defining a four sided frame. The spring-loaded locking members of the first and second pairs of elements are diagonally disposed to one another. By manually manipulating the spring-loaded fastening members of the first pair, the width of the frame may be expanded or contracted to conform to the width of the particular sheet of fabric on which needlepoint work is being performed and which sheet is desired to be held in the frame. When the spring-loaded fastening members of the second pair are similarly manipulated, the length of the frame may be expanded or contracted. The four elongate members have fastening means thereon that removably engage the marginal edge portions of the needlepoint work piece after the frame has been adjusted to accommodate the workpiece. When the frame is not in use it may be taken apart without the use of hand tools, and the elements comprising the frame stored side-by-side in parallel relationship to occupy a minimum of space. The elements are preferably formed from a polymerized resin by conventional molding techniques.

BRIEF DESCRIPTION OF THE DRAWING

FIG. 1 is an exploded perspective view of one of the elements that comprises the needlepoint supporting frame, which element includes an elongate member having first and second ends, a head mounted on a first end of the elongate member, and a fastening member and spring used in holding the fastening member in position on the head;

FIG. 2 is a bottom plan view of the elongate member and head shown in FIG. 1, and illustrating an elongate groove that extends longitudinally in the elongate member to be engaged by a resilient strip to hold a marginal edge portion of the fabric work piece in position on the elongate member;

FIG. 3 is a top plan view of the needlepoint supporting frame that may be manually adjusted to the desired width and length to accommodate a needlepoint work piece that is removably secured thereto;

FIG. 4 is an end elevational view of the adjustable frame shown in FIG. 3;

FIG. 5 is a transverse cross-sectional view of one of the elongate members taken on the line 5—5 of FIG. 2.

DESCRIPTION OF THE PREFERRED EMBODIMENT

The adjustable needlepoint supporting frame A as shown in FIG. 3, includes first, second, third and fourth elongate members B-1, B-2, B-3 and B-4 that are identical in structure and each of which has a first end 10 and second end portion 12. Each elongate member B-1, B-2, B-3 and B-4 has first and second opposed side surfaces 14 and 16, and first and second edge surfaces 18 and 20.

First, second, third and fourth heads C-1, C-2, C-3 and C-4 are provided that are of identical structure, and are preferably formed as integral parts of the first, second, third and fourth elongate members B-1, B-2, B-3 and B-4 on first ends 10 thereof, as may be seen in FIG. 3.

The first, second, third and fourth heads C-1, C-2, C-3 and C-4 are of identical structure, and accordingly only the structure of the first head C-1 will be described in detail.

Head C-1 includes a transverse channel-shaped member defined by a web 22 and first and second laterally spaced flanges 24 and 26 that extend outwardly from the side edges of the web as may be seen in FIG. 1. The first and second flanges 24 and 26 have first and second axially aligned openings **24*a* and 26*a* formed therein as shown in FIG. 3 that are aligned with elongate cavity 28 formed in elongate member B-1. The center of each web 22 has a transverse guide recess 30 therein that extends between first and second openings 24*a* and 26*a* as shown in FIG. 1. An inverted channel-shaped guide 32 projects outwardly from second flange 26 and is normally disposed thereto. Guide 32 is axially aligned with first and second openings 24*a* and 26*a*. First elongate member B-1 is preferably molded from a polymerized resin and has a tooth defining rack 34 formed in the first edge surface 18** thereof, as shown in FIG. 1. First, second, third and fourth heads C-1, C-2, C-3 and C-4 have first, second, third and fourth locking members D-1, D-2, D-3 and D-4 operatively associated therewith. The locking members above-identified are identical in structure and only first locking member D-1 will be described in detail.

Locking member D-1 includes an elongate, rectangular strip 36 that has a rectangular button 38 on a first end thereof and a block 40 on a second end of the strip. The block 40 on the surface thereof most adjacent button 38, has a number of spaced teeth 42 formed thereon, which teeth are normally disposed to strip 36.

Block 40 may have an opening 40a therein if desired.

A prong 44 extends outwardly from block 40 in a direction away from teeth 42. A compressed helical spring 46 encircles prong 44, with the spring being in abutting contact with the bottom 28*a* of cavity 20 when the first, second, third and fourth members B-1, B-2, B-3 and B-4 are disposed as shown in FIG. 3, the first, second, third, and fourth heads C-1, C-2, C-3 and C-4 have the first, second, third and fourth locking members D-1, D-2, D-3 and D-4 in engagement with racks 24. The first pair of elongate members B-1 and B-2 may be moved towards or away from one another by concurrently pressing inwardly on buttons 38 associated with the first and second heads C-1 and C-2. Inward movement of these two buttons results in inward movement of first and second locking members D-1 and D-2 to separate teeth 42 from racks 34 most adjacent thereto. Frist head C-1 and elongate member B-1 can now move longitudinally relative to third elongate member B-3, as fourth elongate member B-4 and fourth head C-4 move longitudinally relative to second head C-2.

Thus the width of the needlepoint holding frame A may be varied to a side to accommodate the sheet E on which the needlepoint work is being performed. By pressing inwardly on the buttons 38 a second pair of the elongate members B-3 and B-4 may be moved longitudinally relative to elongate members B-2 and B-1 to lengthen frame A to a desired degree.

The first side surfaces 14 of the first, second, third and fourth elongate members B-1, B-2, B-3 and B-4 have grooves 48 formed therein that are engaged by resilient strips 50. When the frame A has been adjusted to a desired size, marginal edge portions 52 of the sheet E are held in the grooves 48 by the resilient strip 50 as shown in FIG. 5. When the needlpoint work has been completed, the sheet E may be removed from the frame A by separating the strips 50 from the groove 48. The frame A may now be taken apart, and the elements comprising the same disposed side-by-side in compact, parallel relationship and stored in a compact state.

The use and operation of the invention has been described previously in detail and need not be repeated.

I claim:

1. A frame that may be manually adjusted to a desired length and width to removably hold a sheet of material on which needlepoint work is being performed within the confines thereof, said frame comprising:

a. first, second, third and fourth elongate members having first and second ends, each of said members having first and second side surfaces, and first and second edge surfaces, each of said first surfaces having an elongate tooth defining rack thereon, b. first, second, third and fourth heads on first ends of said first, second, third and fourth members, each of said heads including a transverse channel-shaped member defined by an elongate web normal to said first side surface most adjacent thereto and first and second parallel laterally spaced flanges that project from said web towards said second side surface most adjacent thereto, first and second openings in said first and second flanges that are longitudinally aligned with an elongate cavity in said first end of said elongate member most adjacent therein;

c. first, second, third and fourth locking members disposed on said first, second, third and fourth webs and slidably movable in said first and second openings and cavity most adjacent thereto, each of said locking members including a rectangular strip having first and second ends, a positioning button on said first end of said strip and a block on said second end of said strip, said block having a plurality of spaced teeth defined on the surface thereof most adjacent said button on said strip;

d. first, second, third and fourth compressed springs in said first, second, third and fourth cavities that abut against said blocks on said first, second, third and fourth locking members that tend at all times to move said first, second, third and fourth locking members outward where said buttons thereof project outwardly from said first, second, third and fourth heads; and e. first means for removably holding the edges of said sheet on said first side surfaces of said first, second, third and fourth elongate members, when said first and second elongate members are disposed in parallel, laterally spaced relationship to define a first pair thereof and said third and fourth elongate members are disposed in parallel, laterally spaced relationship to define a second pair thereof, said first and second heads having the channel-shaped members thereof engaging said third and fourth members and being removably held in engagement therewith by said teeth on said blocks of said first and second locking members being forced by said springs associated therewith into interlocking engagement with said tooth defining racks on said third and fourth members, and said heads on said third and fourth members similarly engaging said second and first members to define said frame and of such size that said sheet is held in a taut position thereon.

2. A frame as defined in claim 1 in which said first side surfaces of said first, second, third and fourth elongate members have longitudinal grooves therein that may have marginal edge portions of said sheet disposed thereover, and said first means are four strips of a solid resilient material that removably and frictionally fit within said grooves, and serve to hold said marginal edge portions therein when said marginal edge portions and strips are concurrently forced therein.

3. A frame as defined in claim 1 in which said first, second, third and fourth elongate members and first, second, third and fourth associated heads are molded as integral units from a rigid polymerized resin.

4. A frame as defined in claim 1 which in addition includes:

e. first, second, third and fourth prongs that extend from said blocks of said first, second, third and fourth locking member into said cavities most adjacent thereto, and said first, second, third and fourth springs being compressed helical springs disposed in said cavities that encircle said prongs and are in abutting contact with said blocks most adjacent thereto.

* * * * *